United States Patent [19]

Mizia et al.

[11] Patent Number: 4,792,417

[45] Date of Patent: Dec. 20, 1988

[54] STAINLESS STEELS STRESS CORROSION INHIBITORS

[75] Inventors: Franco Mizia, Milan; Franco Rivetti, Schio; Ugo Romano, Vimercate; Luigi Rivola, San Donato Milanese; Giuseppe Civardi, Piacenza, all of Italy

[73] Assignee: Enichem Sintesi S.p.A., Palermo, Italy

[21] Appl. No.: 943,682

[22] Filed: Dec. 19, 1986

[30] Foreign Application Priority Data

Dec. 19, 1985 [IT] Italy ..... 23288 A/85

[51] Int. Cl.[4] ..... C23F 11/14

[52] U.S. Cl. ..... 252/392; 422/16; 558/260; 558/275

[58] Field of Search ..... 558/260, 275; 252/392; 422/16

[56] References Cited

U.S. PATENT DOCUMENTS

| | | | |
|---|---|---|---|
| 2,635,100 | 4/1953 | Werntz | 558/260 X |
| 2,648,678 | 8/1953 | Heigerger | 558/275 X |
| 3,031,455 | 4/1962 | Holysz | 252/392 X |

*Primary Examiner*—Matthew A. Thexton

*Attorney, Agent, or Firm*—Birch, Stewart, Kolasch & Birch

[57] ABSTRACT

A composition of matter for inhibition of stress corrosion of stainless steels in contact with aqueous and/or polar organic solutions which contain chloride ions and optionally cuprous ions, comprising an aqueous or polar organic solution of a member selected from the group consisting of quaternary ammonium alkylcarbonates and quaternary ammonium benzylcarbonates having the general formula:

$$R_2-\overset{R_1}{\underset{R_3}{N}}-R_4^{(+)}R_4-O-CO_2^{(-)}$$

or $$R_2-\overset{R_1}{\underset{R_4}{N}}-R_4^{(+)}R_4-O-CO_2^{(-)}$$

5 Claims, No Drawings

STAINLESS STEELS STRESS CORROSION INHIBITORS

The present invention relates to inhibitors of stress corrosion of stainless steels.

It is known that steels in general, and also stainless steels undergo stress corrosion, when they are in contact with some types of liquids or solutions.

It has been observed that the stress corrosion is particularly noxious in the case of contact with solutions containing $Cu^{++}$ and $Cl^{-}$ ions.

The possible solutions the art offers in the latter exposed case, which is the one we are mostly interested in, are either using stainless steels of the Hastelloy type, with a consequent increases in equipment cost, or reducing the contents of $Cu^{++}$ and $Cl^{-}$ ions by means of a series of beds of anionic and cationic resins, with consequent increase in plant operational cost both as it relates to the resins cost and consumption, and to the regeneration thereof.

It should be furthermore observed that the lower the concentration of $Cu^{++}$ and $Cl^{-}$ ions, the more difficult is their separation by means of resins, so that, already starting from values of $Cu^{++}$ and $Cl^{-}$ ion concentrations of 2 and 10 ppm, respectively, the cost for such a separation would be prohibitive. It has been suprisingly found that the stress corrosion in the presence of $Cl^{-}$ ions, and possibly in the presence of $Cu^{++}$ ions too, can be eliminated by resorting to corrosion inhibitors dissolved in the aqueous and/or polar organic solution containing said ions in contact with the stainless steel. Advantageously, the concentration of the Current$^{++}$ $Cl^{-}$ ions are first reduced by known means, in particular by such means as above mentioned, to maximum values of 2 ppm and 10 ppm, respectively, preferably 1 and 5 ppm.

The corrosion inhibitors according to the invention are selected from the class of the quaternary ammonium alkyl or benzyl carbonates having general formula

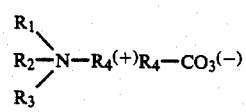

or

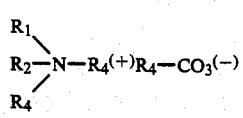

wherein: $R_1$ is a linear or branched, saturated or unsaturated, possibly hydroxylated alkyl radical containing from 1 to 30 carbon atoms; $R_2$ and $R_3$ are alkylaryl radicals, in particular benzyl radicals, possibly bearing one or more substituents on their ring, or have, individually, the same meaning as $R_1$; $R_4$ is an alkyl radical of from 1 to 4 carbon atoms, or is a benzyl radical.

The carbonate used according to the present invention is obtained by means of a dialkylcarbonate having the formula:

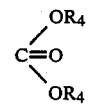

with respectively a tertiary or secondary amine having the formula:

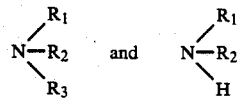

wherein: $R_1$, $R_2$, $R_3$ and $R_4$ have the above said meaning, in the liquid phase, at temperatures of from about 100° to about 200° C., with an amount of carbonate equal to, or higher than the stoichiometric amount for the reaction with the amine, up to complete, or substantially complete conversion of the same amine.

The reaction between the dialkylcarbonate and the tertiary amine can be described as follows:

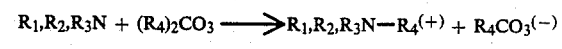

The reaction between the dialkylcarbonate and the secondary amine can be described as follows:

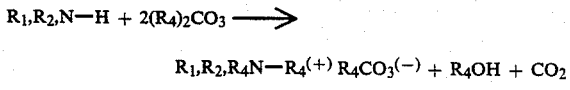

That is to say, the alcohol corresponding to radical $R_4$ in the carbonate, as well as carbon dioxide, is formed.

Examples of dialkylcarbonates useful as alkylating agents are dimethylcarbonate, methylethylcarbonate, methylpropylcarbonate, methylbutylcarbonate, methylbenzylcarbonate, diethylcarbonate and dibenzylcarbonate.

Examples of tertiary amines useful for the purposes of the present invention are N,N-dimethylbenzylamine, trimethylamine, triethylamine, tri-n-propylamine, tri-n-butylamine, dimethylcetylamine and dimetylstearylamine. Examples of secondary amines useful for the purposes of the present invention are: laurylmyristylamine, dipropylamine, benzylcetylamine, dimethylamine, diethylamine, di-n-butylamine and benzylmethylamine.

The molar ratio between carbonate and amine is equal to at least 1/1 in case of tertiary amines and at least 2/1 in case of secondary amines. It is generally preferable to use an excess of carbonate relatively to the stoichiometric value, and, in practice, operating is possible with values of such a ratio of up to 10/1, with the values of from 3/1 to 5/1 being preferred. The possibly use of excess carbonate remains unchanged, and can be recovered for a subsequent use.

The reaction is carried out at a temperature of from about 100° to about 200° C. and preferably of from 130° to 160° C. and under such a pressure as to keep the reaction mixture in the liquid phase. The reaction conditions are a function of the nature of the amine, of the carbonate and of the solvent utilized. In practice, the pressure can vary from atmospheric pressure up to about 15 bars.

The reaction times depend on the nature of reactants used, and on the other conditions under which the reaction is carried out. Generally, under the conditions as set forth, the reaction is complete, or nearly complete, within a time of from 1 to 30 hours.

Furthermore, the reaction can be carried out in the presence of an added, not reactive, and preferably polar solvents. Solvents suitable for this purpose are the alcoholic solvents (in particular, methanol and ethanol), hydrocarbon solvents and ethereal solvents.

In order to achieve the highest reaction rate, should it be regarded as useful, a substance may be used, which performs a catalytic action on the formation of quaternary ammonium carbonates, such as organic and inorganic iodides, for example, methyl iodide, ethyl iodide and sodium and potassium iodides. The catalyst can be used in amounts of from 0.1 to 5 mol per each 100 mol of amine, and preferably of from 0.5 to 2 mol per 100 mol of amine.

At the end of the reaction, the quaternary ammonium carbonate can be separated from the reaction mixture by simple filtration, when said product separates in the solid form at temperatures lower than the reaction temperatures.

As an alternative, the separation can be carried out by evaporating off the unchanged dialkylcarbonate, the solvent, if any, as well as the byproduct alcohol.

The separation can be also simply accomplished by pouring the reaction mass into water and separating the carbonate excess, which is insoluble in the aqueous ammonium hydroxide solution.

The inhibitor concentration in the aqueous and/or polar organic solution containing $Cu^{++}$ and $Cl^-$ ions is within the range of from 50 to 1000 ppm, preferably of from 100 to 600 ppm.

The corrosion inhibitors in accordance with the present invention allow, at the concentrations mentioned, austenitic, austeno-ferritic and superaustenitic stainless steels to be passivated, in a complete way, against stress corrosion, when the concentrations of $Cu^{++}$ and $Cl^-$ ions are not higher than 2 and 20 ppm, respectively.

Should the values of concentrations of $Cu^{++}$ and $Cl^-$ ions be higher than the above limits, the inhibitors of the present invention allow the stress corrosion to be reduced, but it is not to be completely eliminated.

The inhibitors of the present invention can be used in aqueous solutions, or in polar organic solutions, or also in water-polar organic liquid solutions or dispersions, with the maximum limit of concentration of $Cu^{++}$ and $Cl^-$ ions being the only limitation.

Among the polar organic liquids, there should be mentioned the alcohols, and among these, in particular, methanol and ethanol; the ketones, and among these, in particular, acetone; and the esters.

We underline moreover that the activity of the inhibitors according to the present invention is in no way influenced by the presence, in the aqueous and/or organic solution, of organic compounds therein dissolved or dispersed, such as, e.g., esters, aldehydes or still others.

Some examples are now supplied for the purpose of better explaining the invention, it being understood that the present invention is not to be considered as being limited to them or by them.

EXAMPLES 1, 2, 3

All of the exemplified tests have been carried out in an AISI-316 autoclave internally protected by a teflon coating. As the specimen, a ring of AISI 304 L stainless steel of 10 mm in height and 20 mm in diameter has been used. The specimen has been kept stressed and heated at a temperature of 120° C., under a $N_2$ atmosphere, over a 7-days time.

The inhibitors used in the three examples have been, respectively, trimethyl-ethanol-ammonium methoxycarbonate (TMEA), trimethyl-cetyl-ammonium methoxycarbonate (TMCA), and trimethyl-stearyl-ammonium methoxycarbonate (TMSA), at the concentration of 200 ppm in the organic compound being in contact with the ring.

In the three examples, the contents of $Cu^{++}$ and $Cl^-$ was respectively of 1 and 5 ppm, 2 and 10 ppm, 4 and 20 ppm. The blank tests, carried out in the absence of the inhibitor, have caused the presence of cracks for each corrosive medium used in the tested specimens.

The data obtained are shown in Table 1.

TABLE 1

| | Solution | Penetration, mm/year | Presence of cracks |
|---|---|---|---|
| Ex. 1 | Organic compound + 6.36% of $H_2O$ + 200 ppm of TMEA + 1 ppm $Cu^{++}$ + 5 ppm $Cl^-$ | 0,0030 | no cracks |
| Ex. 2 | Organic compound + 6.36% of $H_2O$ + 200 ppm of TMCA + 2 ppm $Cu^{++}$ + 10 ppm $Cl^-$ | 0,0036 | no cracks |
| Ex. 3 | Organic compound + 6.36% of $H_2O$ + 200 ppm of TMSA + 4 ppm $Cu^{++}$ + 20 ppm $Cl^-$ | 0,0034 | no cracks |

EXAMPLES 4 TO 8

In these examples, the influence is evidenced of the concentration of $Cl^-$ in the absence of $Cu^{++}$, by using, as the inhibitor, trimethyl-ethanol-ammonium methoxycarbonate (TMEA) at a concentration of 100 ppm.

Temperature=120° C., $N_2$ atmosphere, material=-mechanically tensioned AISI 304, for a time of 7 days.

The examples show also the unfitness, as for the stress corrosion, of a commercial product (used at a concentration of 100 ppm).

| | Inhibitor | $Cl^-$ (ppm) | Penetration mm/year | Intercrystal Corrosion |
|---|---|---|---|---|
| Ex. 4 | TMEA | 10 | 0.0027 | no corrosion |
| Ex. 5 | TMEA | 15 | 0.0032 | no corrosion |
| Ex. 6 | TMEA | 20 | 0.0046 | no corrosion |
| Ex. 7 | TMEA | 100 | 0.0209 | yes |
| Ex. 8 | VISCO D44 (NALCO) | 10 | 0.0200 | yes |

We claim:

1. A composition of matter for inhibition of stress corrosion of stainless steels in contact with aqueous and/or polar organic solutions which contain chloride ions and optionally cuprous ions, comprising an aqueous or polar organic solution of a member selected from the group consisting of quaternary ammonium alkylcarbonates and quaternary ammonium benzylcarbonates.

2. The composition according to claim 1 wherein the quaternary ammonium alkyl or benzyl carbonates are selected from the group consisting of trimethyl-ethanol-ammonium methoxycarbonate, trimethyl-cetyl-ammonium methoxycarbonate and trimethyl-stearyl methoxycarbonate.

3. The composition according to claim 1 wherein said carbonate is present in a concentration of from 50 ppm to 1000 ppm.

4. The composition according to claim 3, wherein said carbonate is present in a concentration of from 100 to 600 ppm.

5. The composition according to claim 1 wherein the quaternary ammonium alkyl- or benzylcarbonates have the general formula:

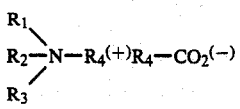

-continued or

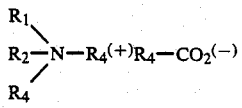

wherein: $R_1$ is a linear or branched, saturated or unsaturated alkyl radical containing from 1 to 30 carbon atoms; $R_2$ and $R_3$ are alkylaryl radicals or benzyl radicals, optionally bearing one or more substitutes on their ring, or which have, individually, the same meaning as of $R_1$, $R_4$ being an alkyl radical of from 1 to 4 carbon atoms, or benzyl radical.

* * * * *